US006086102A

United States Patent [19]

Stark et al.

[11] Patent Number: 6,086,102

[45] Date of Patent: Jul. 11, 2000

[54] TRANSPORT DEVICE FOR SKIS AND POLES

[75] Inventors: Joel Stark; Tod Shultz, both of Arlington, Tex.

[73] Assignee: Innovative Ski Systems, Arlington, Tex.

[21] Appl. No.: 09/114,776

[22] Filed: Jul. 13, 1998

[51] Int. Cl.[7] ..... A63C 11/02

[52] U.S. Cl. ..... 280/814; 224/917; 280/47.32; 294/147

[58] Field of Search ..... 224/147, 917; 294/137, 147; 280/809, 814, 815, 47.3, 47.32, 78, 652

[56] References Cited

U.S. PATENT DOCUMENTS

| | | | |
|---|---|---|---|
| 2,224,586 | 12/1940 | Altorfer | 224/917 X |
| 4,553,779 | 11/1985 | Shortridge | 224/917 X |
| 4,666,184 | 5/1987 | Garvey . | |
| 4,674,787 | 6/1987 | DeVera | 280/814 X |
| 4,705,281 | 11/1987 | Spinas | 280/814 X |
| 4,746,159 | 5/1988 | Webb et al. | 280/814 X |
| 4,852,931 | 8/1989 | Ferdi | 280/814 X |
| 4,940,255 | 7/1990 | Donine | 224/586 X |
| 4,968,060 | 11/1990 | Rooney . | |
| 4,982,883 | 1/1991 | Ullal et al. | 224/917 X |
| 5,340,153 | 8/1994 | Parker . | |
| 5,383,587 | 1/1995 | Carpenter | 224/917 X |
| 5,450,991 | 9/1995 | Neading | 280/814 X |

*Primary Examiner*—Michael Mar

[57] ABSTRACT

A ski equipment transport device is provided for eliminating the hassles of carrying snow skis and poles independently. An integral bag, handle and contoured base is deployed by opening the bag securement and emptying the contents. The bag and straps are affixed to a pair of snow skis and poles by placing the ski tails into the contoured base and securing the crossover strap and hand loops. The handle is grasped and the ski and poles are pulled using the transport device thereby eliminating a portion of the weight of the skis.

7 Claims, 4 Drawing Sheets

TRANSPORT DEVICE FOR SKIS AND POLES

BACKGROUND-FIELD OF INVENTION

The present invention relates to a collapsible snow ski and pole transporting device with integral handles and storage bag.

BACKGROUND-DESCRIPTION OF RELATED ART

The traditional means of moving ski equipment from one location to another is to hoist skis onto shoulders and balance them with one hand while carrying poles and boots with the other hand. This mode of ski equipment transport is difficult and cumbersome for the skier. It is also dangerous since the skis and poles are usually carried in a horizontal position at eye level. In this position skis and poles may hit other people, walls, or windows thereby causing damage. This is especially true for the novice and vacationing skier who has never carried skis and poles, or carries them only a couple of times per year. This equipment is heavy and quite difficult to balance. More importantly, some skiers find they cannot carry the equipment due to physical limitations.

There are several commercially available products that bind the skis and poles together. Examples are Ski-Tote™ and Ski-Relay™. These devices have made carrying skis and poles easier but have failed to reduce the total weight the skier must carry. These traditional carrying devices employ elasticized straps with small hooks, or clamps to secure skis and poles. The means of securing the straps around skis and poles can be difficult to execute since ski gloves are typically worn in cold weather. It is common for the hooks or clamps to become unfastened when jarred during transport, causing the skis and poles to become loose and fall.

There have been several inventions that employ wheels that allow a skier to pull skis, poles, and boots alongside them. U.S. Pat. No. 5,340,153 to Parker discloses a ski transport dolly that allows skis and poles to be fastened onto a wheeled dolly, or cart. The skier then pulls the dolly behind them to and from the ski area. This invention reduces the weight carried by the skier but is cumbersome, time consuming to assemble, and the dolly creates a storage issue due to it's size. U.S. Pat. No. 4,666,184 to Garvey shows opposing wheeled carriages; however, multiple wheels will not roll effectively in snow or mud. Another disadvantage to the Garvey's invention is the method by which the skis are locked into the carriages. The user must balance skis and the opposing carriages while wrapping and securing an attached strap. The Garvey invention does not address the ski poles. Garvey states the opposing wheeled carriages may be collapsed and placed into the skier's pocket. The carriages will be quite messy after use in most ski area parking lots. The carriages will require cleaning or the skiers pocket will contain mud and snow.

In U.S. Pat. No. 4,968,060 issued to Rooney, a transport device is disclosed that uses a small single wheeled device which requires the skis to be placed on opposite sides of a center member. A strap is then wrapped around the skis and securely fastened. This is quite difficult to do and requires that the skier kneel down or lift the skis to a workable height. In either case, it is difficult to balance the two opposing skis. Rooney does not address the ski poles, and requires a separate handle be attached to the ski tips for pulling.

These inventions have taken the right general approach but are large, difficult to use, and cumbersome. These inventions are typically too large to fit into a ski jacket pocket or fanny pack. This makes it necessary for the skier to find a place, such as a locker, to store the device once skis, poles, and boots are dismounted from the carrier.

OBJECTS AND ADVANTAGES

Accordingly, several objects and advantages of the present invention are:

a. A lightweight cart that has a full width solid wheel and rolls over snow, mud, gravel and concrete. The cart is shaped like the tail of a ski and has a built in scraper to remove rocks, mud or snow that has adhered to the wheel thereby allowing it to roll, or slide, freely over all terrain.

b. The wheeled cart is attached to side straps that adjusts to fit any size skis.

c. The side straps are attached to a bag that is used for storage of the wheeled cart, side straps and handles. All pieces are attached so there are no loose pieces to misplace or forget. The side straps wrap easily around the wheeled cart and insert into the bag for storage.

d. A compact bag that fits easily into the pocket of ski jacket. The bag is partially zippered around the periphery, and creates a pouch to store the connected side straps, handles and wheeled cart.

e. The handles are a made of a continuous loop which allows the skis and poles to be balanced easily. This feature also causes the skis and poles to naturally follow in a straight line behind the user.

f. Easy to use for all ages and dexterity levels. Unzip bag and empty contents to deploy. A single unit made of multiple pieces that easily deploys and accepts ski equipment from a standing position.

g. Poles are easily secured with the built in handles. The poles are hooked over the ski tips with the pole wrist straps. The continuous handle is used to secure the poles and to pull the transport device.

h. Reduces the effective load on the skier since the ski tails are rolling.

i. the wheel assists in loading equipment into vehicle compartments(bus, car, etc.)

j. In the transporting configuration skis are braced by the ground in a safer more vertical position. This makes the turning radius smaller, therefore easier to maneuver in busy ski areas(hotels, shops, gondola, etc.). This translates to a safer ski area since the skis are no longer in the horizontal position at eye level. Further objects and advantages of the present invention will become apparent from a consideration of the drawings and ensuing description.

SUMMARY OF THE INVENTION

To avoid the limitations and problems with present devices the object of this invention is to present a device that provides a combination handle and storage bag, wheeled base unit, and a harness to secure skis and poles for pulling them along snow, pavement, or indoor surfaces. This invention is constructed in such a fashion so that all the parts mentioned are fixed to each other forming one singular device that easily stores inside its attached storage bag. This device will then easily fit into a ski jacket pocket.

DETAILED DESCRIPTION OF THE INVENTION

Figure 1:
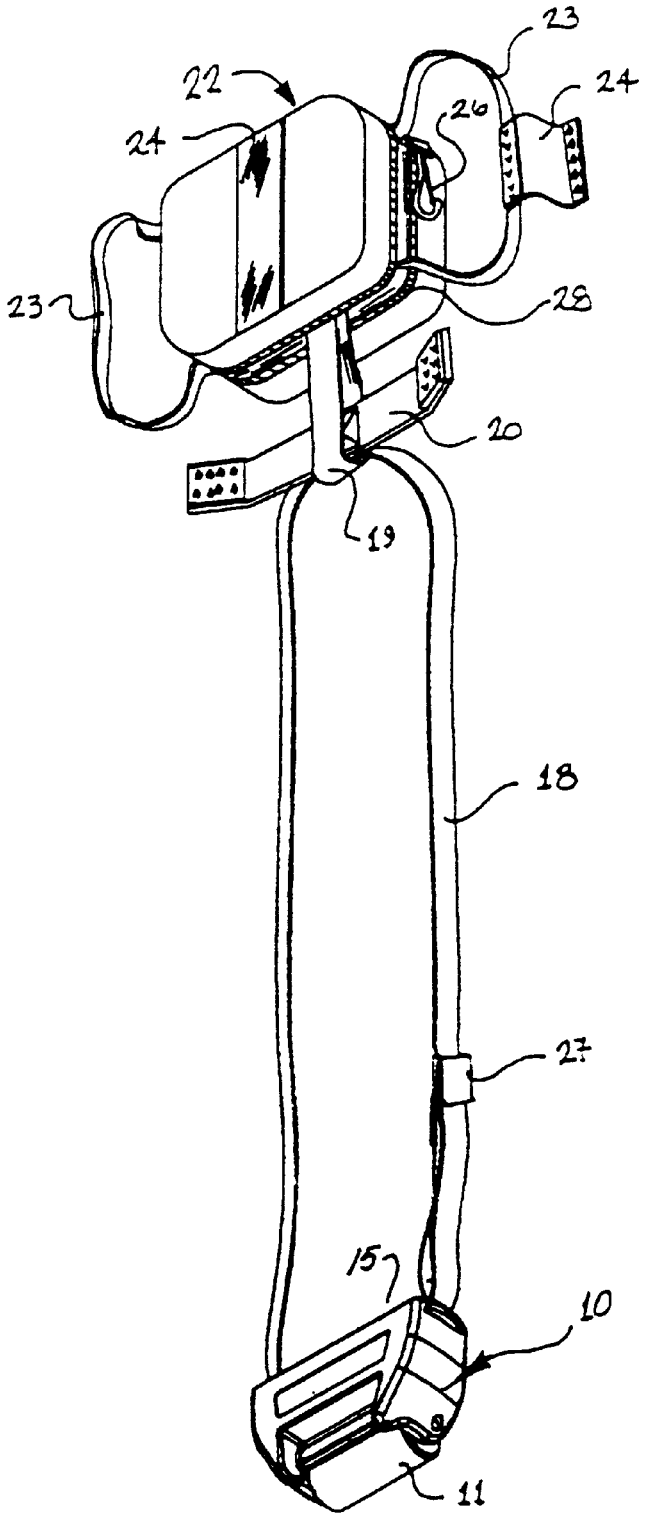
FIG. 1 The transport device in a deployed transport configuration.

The preferred embodiment of the present invention is illustrated in FIG. 1 and consists of a contoured plastic base 10 which contains a rectangular cavity 15 in which ski tails will sit when placed therein with bottom surfaces abutting. In the preferred embodiment the base unit is injection molded using a tough, durable plastic, such as Surlyn® available from the DuPont Corporation. However, the base can be made of any material that has the required toughness, impact resistance and abrasion resistance at the temperature extremes(−30 F. to 140 F.) the product will encounter. The contoured base unit 10 has four sides referred to as 10*a,* 10*b,* 10*c* and 10*d*(FIG. 2*a*). The contoured base face 10*c,* referred to as the front, and 10*d* referred to as the back, are wider along the top and contour towards the bottom in the shape of a ski tail (FIG. 2*d* and 2*f*) with two points 14*a* and 14*b* on opposite sides that allow the base unit to be stable when placing the skis into the aforementioned rectangular cavity 15. A wheel scraper 17(FIG. 2*a*) is formed between the opposing stabilizing points 14*a* and 14*b* and keeps wheel 11 from becoming jammed by rocks, dirt and debris. The section view of FIG. 2*e* shows the proximity of the scraper 17 to wheel 11. The wheel of the preferred embodiment is made of a 70 durometer, solid polyurethane roller with a longitudinal through hole to accommodate an axle 12 which is preferentially made of stainless steel. The wheel 11 is secured to the axle 12 and the base unit 10 by e-rings 13*a* and 13*b* on opposing ends of the wheel(FIG. 2*d*). On ends 10*a* and 10*b,* and passing through the outer wall of base unit 10 into the cavity 15 are oblong holes 16*a* and 16*b* for attaching side strap 18 that also has a buckle 27 for adjustability for all sizes of skis. The side strap can be made of any type of cord or strap that is made of any type of material. The preferred material is polypropylene or nylon strapping.

Figure 3:
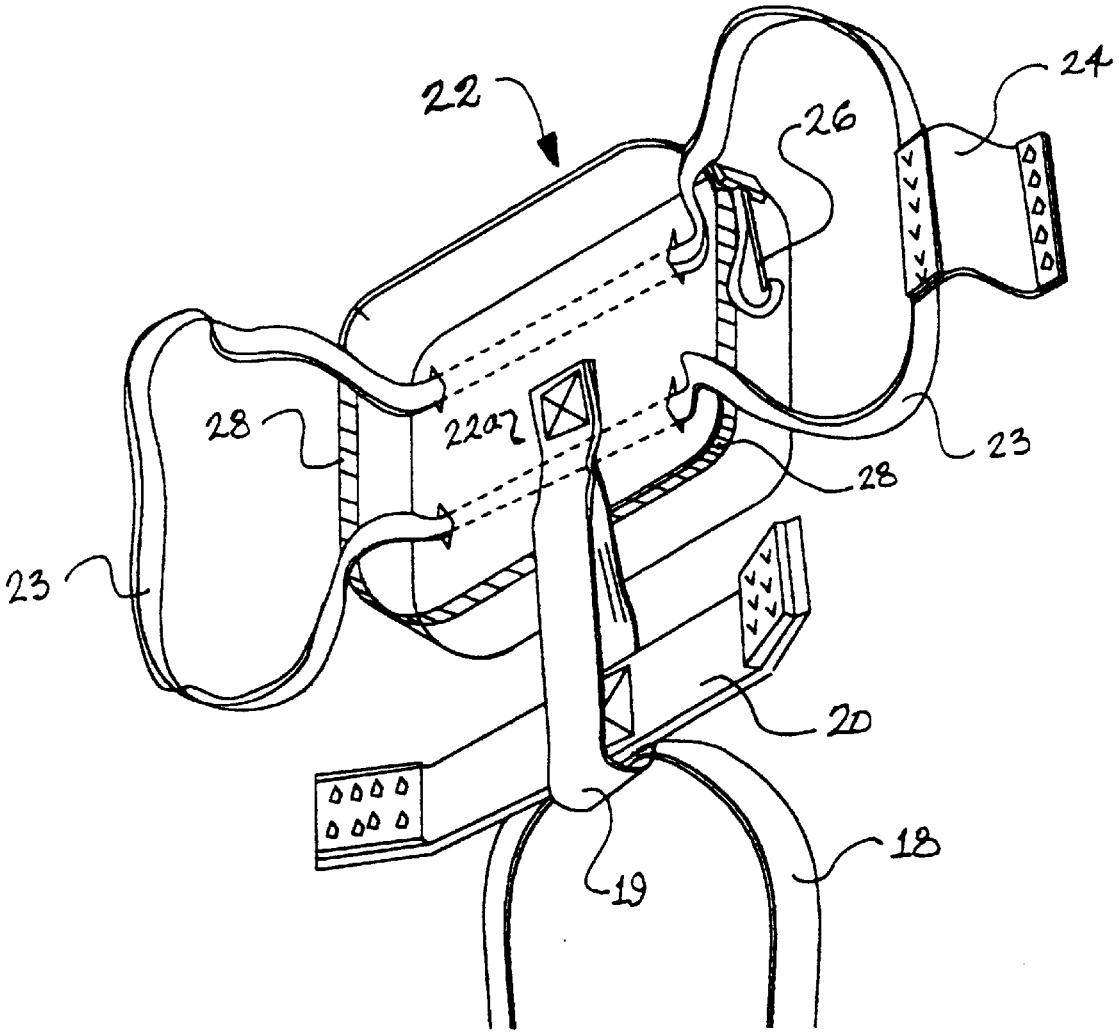
FIG. 3 Cut away view of the bag showing hand loops and side straps

In the preferred embodiment, the side strap 18 is permanently fixed to the base unit 10 through oblong opening 16*a* and passes through an attachment loop 19 and passes through the opening 16*b* and attaches to buckle 27(FIG. 3). The preferred buckle is referred to as a cambuckle, but could be any type of adjustable hardware. The side strap may even be cut to length and sewn if it will be used on only one set of skis. Attached to attachment loop 19 is crossover strap 20. The crossover strap is preferentially a nylon or polypropylene strap with hook and loop fastening materials on opposite ends, but could be made of any type of cloth, fabric or plastic strap or cord. The attachment loop 19 is attached to the inner layer 22*a* of the storage bag 22. All attachments referred to are preferentially accomplished by sewing, but may also be ultrasonically bonded, heat sealed or chemically bonded.

FIG. 3 is a cut-away view of the bag 22 and clearly shows the continuous handle, or hand loops 23, formed by sandwiching the strap that forms the hand loops, between the inner wall 22*a* and outer wall of bag 22. There are two holes on each end of inner wall 22*a* that allow the hand loops 23 to pass through forming channels for adjustability. One hand loop has a handle with pad 24 permanently attached, The bag 22 has zipper 28 on three sides. The hand loops 23 extend between the zipper on each side. The attachment loop 19 extend down between the zipper as shown in FIG. 1. Also shown in FIG. 1 a belt loop 24 is attached to the outer side of bag 22. A snap hook 26 is permanently attached to bag 22 near the end of the zipper.

Figure 2C:
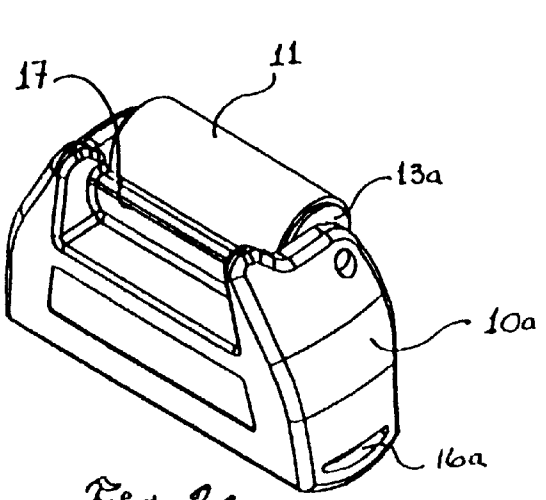
FIG. 2*a–f* Various views of the contoured base with wheel
Figure 2F:
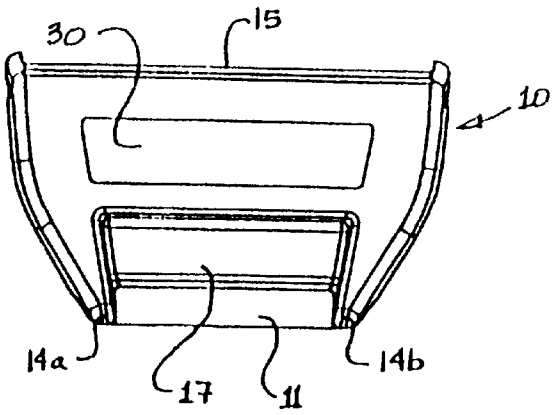
Figure 2B:
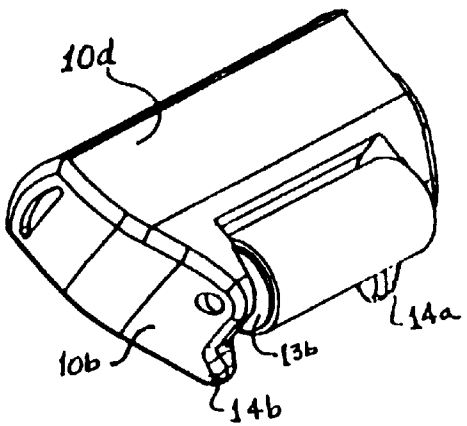
Figure 2E:
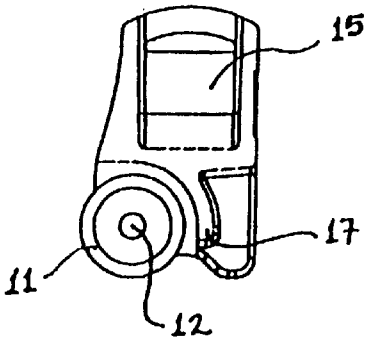
Figure 2A:
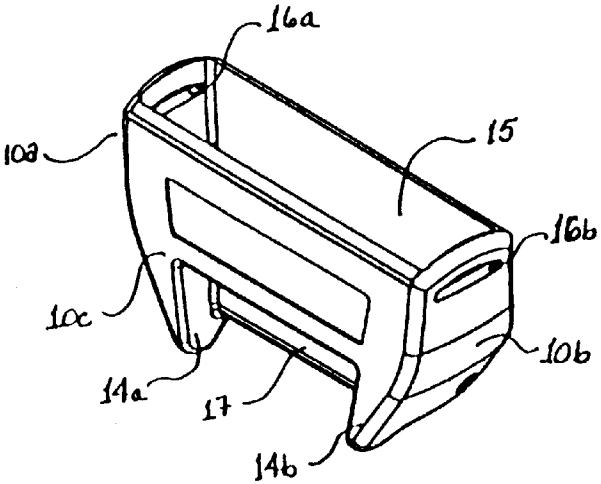
Figure 2D:
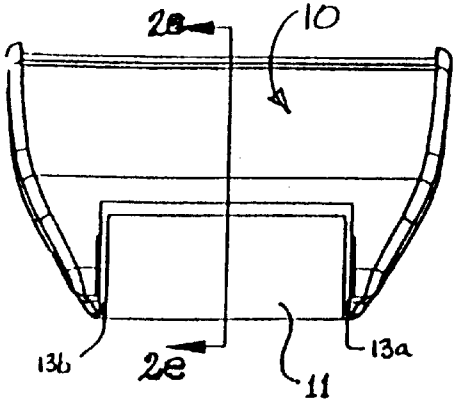
Figure 4A:
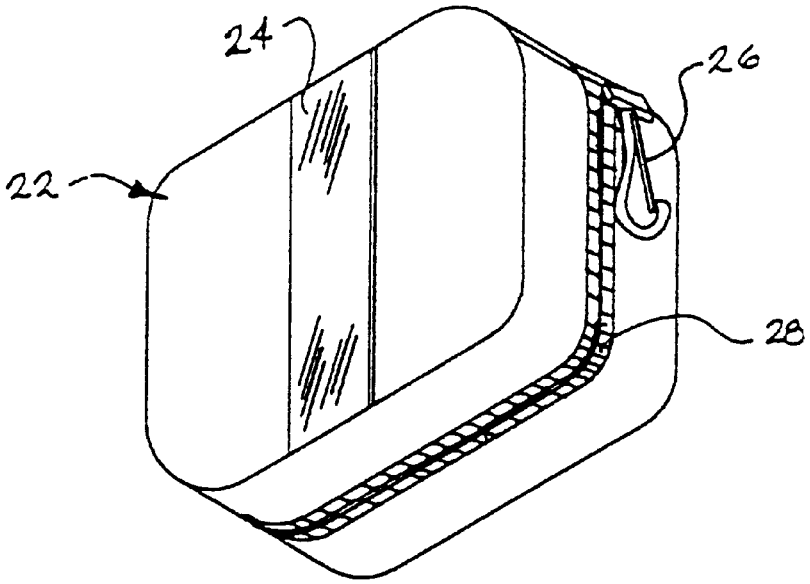
FIG. 4*a* Back View of Bag with contents inside showing belt loop
Figure 4B:
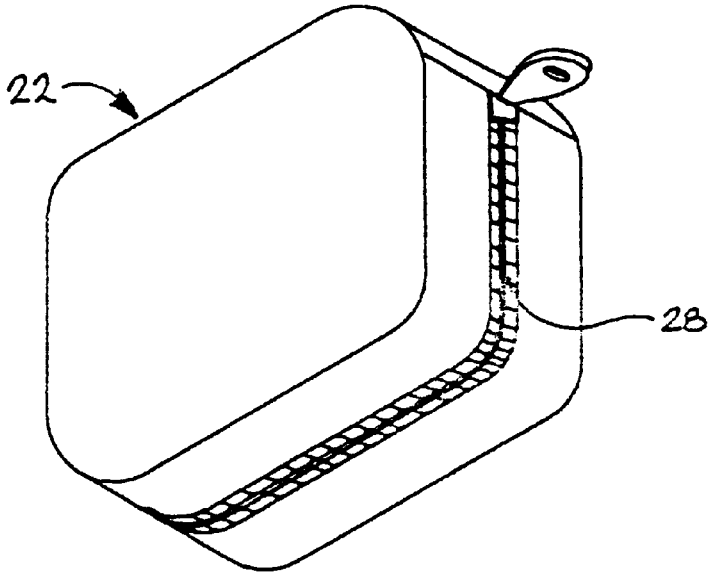
FIG. 4*b* Front View of Bag with contents inside

In FIG. 2*f,* the front view of the contoured base 10 is shown. A logo may be molded into the area labeled 30. A logo may also be embroidered, or printed, onto the front of bag 22 at area 32 in FIG. 4*b.*

The materials used in the invention can vary in type, size and color. The manufacturing processes used to attach, or connect items, may also vary.

OPERATION-MAIN EMBODIMENT

The preferred method of deployment and use for the subject invention is as follows: With the belt loop 24 facing you, unzip bag 22 and empty the contents straight down towards the ground. Straighten the hand loops 23, cross over straps 20, and side strap 17 as necessary, Unsecure the hook and loop on the crossover strap 20 and the handle with pad 24. Place skis with bottoms together. While holding skis in one hand and the transportation device in the opposite hand, place skis into cavity 15 of base unit 10. Place the attachment loop 19 and the side strap 17 just above the ski toe binding. The side strap may be loosened if necessary by opening buckle 18. Wrap the crossover strap 20 around skis and fasten hook and loop together. This holds the skis tightly together. Tighten cam buckle 18 to remove slack in side strap 17. The side strap is tightened to keep the distance from the crossover strap 20 to the base unit 10 constant. This keeps the base unit from slipping off the ski tails.

Ski pole straps may now be placed over the tips of skis and beside the ski bindings. Wrap hand loops 24 over skis and poles and secure handle with pad 24 to both hand loops 23. This creates a single unit out of the skis and poles. Now, grasp handle with pad 24, lower to side and drag, or pull, skis and poles to the slopes. Boots may be draped over the bindings if a common t-handle boot carrier is employed. Place a boot on each side of the skis and drag all equipment as a single assembly. If it is necessary to lean skis for storage, place points 14*a* and 14*b* facing to the side the skis will be leaning. This will keep the assembly from rolling away, or falling.

To place the removable portions of the transport device into it's bag, simply unwrap the hook and loop fasteners on the handle with pad 24 and the crossover strap 20, remove skis and set them aside. Secure hook and loop fasteners. Grasp base unit 10 and wrap side strap 17 around it until the bag is encountered. Place the base unit 10 with side strap into the bag 22. Place hand loops 23 into bag 22 and zip all around. Either clip the bag 22 to clothing using snap hook 26, slide onto belt using belt loop 24 or simply place the bag into your coat pocket.

It is apparent that the wheeled base unit with integral bag of the invention makes the handling of ski equipment much easier than traditional means. The invention is lightweight, rugged and tough for use in all environments and terrain. It fits easily into a coat pocket and can be carried at all times. The invention is easy to deploy and eliminates the hassle associated with carrying skis, poles and boots independently.

While the above description contains many specificities, these should not be construed as limitations on the scope of the invention, but rather as a exemplification of one preferred embodiment thereof. For example, the bag may be larger or smaller and may be shaped differently. It may have hook and loop, or snaps as a means of closure; The side straps may be made retractable to make the unit easier to put into the bag; The bag may include a badge that can be used to identify its owner; A locking device may be an adjunct to, or built into the bag or straps.

Thus the scope of the invention should be determined by the appended claims rather than by examples given.

What is claimed is:

1. A transport device for transporting snow skis and poles, comprising:

a bag having a bottom wall, four sidewalls extending upwardly from the bottom wall, and a top wall, the top wall being hingedly connected to an upper edge of one of the sidewalls and connected by a continuous zipper to the upper edges of the remaining sidewalls to form a cover for the bag;

a strap handle in the form of a single loop, the strap handle having a central portion attached to the bottom wall of the bag and opposed end loop portions extending from the bottom wall through an interior of the bag, one of the end loop portions having a fastener attached thereto for releasably securing the end loop portions together;

an attachment loop having an upper end permanently attached to an interior surface of the bottom wall of the bag;

a crossover strap extending through the attachment loop and affixed thereto, the crossover strap having opposed end portions with fasteners for releasably connecting the opposed end portions together;

a side strap having an upper portion extending through the attachment loop; and a base unit having a main body with an opening at an upper end which extends into a cavity formed in an upper portion of the main body and a wheel rotatably attached to a lower end of the main body, the base unit being attached to lower portions of the side strap;

wherein the hand loops, the attachment loop, the crossover strap, the side strap, and the base unit are adapted to be fully received within the bag in a storage configuration and are adapted to be positioned outwardly of the bag in a transport configuration with tail end portions of the skis being received within the cavity of the base unit, the crossover strap being secured around the skis while the attachment strap is positioned therebelow, and the pair of end loop portions extending around the skis and poles and being secured together to form a single handle while the bag is positioned therebelow.

2. The transport device of claim 1, wherein the bag is made of a plurality of layers of soft material.

3. The transport device of claim 1, wherein the base unit includes oblong holes for attachment of the lower portions of the side strap thereto.

4. The transport device of claim 1, wherein the bottom wall of the bag is formed by inner and outer layers of material, the strap handle extending through openings formed in the inner layer of material with the central portion of the strap handle being positioned between the inner and outer layers of material.

5. The transport device of claim 1, wherein the bag has attached thereto a releasable fastener for attachment to an article of clothing on a person.

6. The transport device of claim 1, wherein the base unit includes a scraper positioned proximate the wheel for preventing debris from entering between the wheel and the main body of the base unit.

7. The transport device of claim 1, wherein the main body of the base unit has downwardly extending protrusions at a lower end which function with the wheel to form a ground engaging support base for maintaining the base unit in an upright position.

* * * * *